United States Patent [19]

Cadars

[11] 4,423,769

[45] Jan. 3, 1984

[54] TURBULATOR RETAINING MEANS

[75] Inventor: Patrick Cadars, Montigny le Bretonneux, France

[73] Assignee: Valeo, Paris, France

[21] Appl. No.: 356,476

[22] Filed: Mar. 9, 1982

[30] Foreign Application Priority Data

Mar. 23, 1981 [FR] France ..... 81 05768

[51] Int. Cl.[3] ..... F28F 9/24

[52] U.S. Cl. ..... 165/109 T; 165/174

[58] Field of Search ..... 165/174, 109 T

[56] References Cited

U.S. PATENT DOCUMENTS 2,691,991 10/1954 Schutt et al. ..... 165/174 X
2,915,294 12/1959 Christensen ..... 165/174

FOREIGN PATENT DOCUMENTS 2248481 5/1975 France ..... 165/174
2269054 11/1975 France ..... 164/174
2378252 8/1978 France ..... 165/174
37204 6/1906 Switzerland ..... 165/174

*Primary Examiner*—Sheldon J. Richter
*Attorney, Agent, or Firm*—Dennison, Meserole, Pollack & Scheiner

[57] ABSTRACT

A heat exchanger, such as the radiator of a motor vehicle, has a nest of tubes through which liquid flows. To improve heat exchange between the liquid and the tube walls, turbulators (18) are inserted into the tubes to make the liquid flow turbulently. One form of turbulator is U-shaped and has two legs, each of which is inserted into a respective one of the tubes in the nest, via downstream ends (12) thereof. To avoid the liquid flow removing the turbulators from the tubes, stops or projections (19) are provided on either side of the bend in the turbulators. The projections may be moulded integrally with the water box which caps the downstream end of the nest of heat exchange tubes.

13 Claims, 10 Drawing Figures

TURBULATOR RETAINING MEANS

The present invention relates to turbulator retaining means for retaining a turbulator in a fluid circulation tube of a heat exchanger, e.g. a radiator in a motor vehicle.

BACKGROUND OF THE INVENTION

Turbulators are inserted in heat exchanger tubes to cause the liquid therein to flow turbulently, thereby improving heat exchange between the liquid and the walls of the tubes. One form of turbulator comprises thin strips of metal or plastic having twisted or helical projections.

However, it has been observed that under certain conditions of temperature or flow rate, there is a tendency for the liquid flowing through the tubes to remove the turbulators and to convey them towards the outlet tube from the heat exchanger. This can lead to the outlet tube becoming more or less blocked, or to the turbulators moving on downstream into the circuit associated with the heat exchanger.

There are also curved or U-shaped turbulators comprising two substantially rectilinear and parallel leg portions each of which is inserted into a respective tube in a nest of heat exchanger tubes, but the problem of retaining the turbulators in the nest of tubes still applies.

Preferred embodiments of the present invention provide a simple, reliable and cheap solution to this problem, applicable to retaining U-shaped turbulators.

SUMMARY OF THE INVENTION

The present invention provides turbulator retaining means in a heat exchanger comprising a nest of tubes for liquid circulation and a plurality of U-shaped turbulators each having two substantially parallel leg portions inserted into respective tubes in said nest, said turbulator retaining means comprising a plurality of stops of projections extending on either side of the U-shaped portion in such a manner as to prevent or to restrict movement of the turbulators out from the tubes in which they are inserted under the effect of the liquid flowing therethrough.

Preferably, the stops or projections project from the inside surface of a water box into which open the ends of the said tubes.

The invention thus makes it possible simply and cheaply to maintain turbulators in position in a heat exchanger's nest of tubes without using additional parts or units, since the retaining means can form part of the same plastic moulding as the water box.

BRIEF DESCRIPTION OF THE DRAWING

Embodiments of the invention are described by way of example with reference to the accompanying drawings, in which.

MORE DETAILED DESCRIPTION

Figure 1:
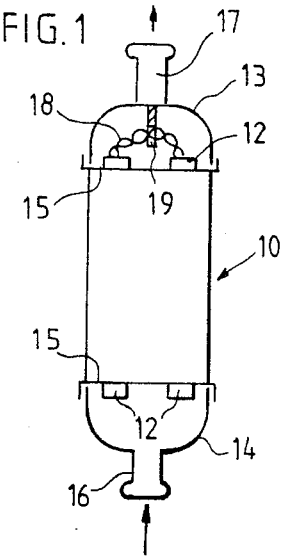
FIG. 1 is a diagrammatic side view of a first heat exchanger fitted with turbulator retaining means in accordance with the invention.
Figure 2:
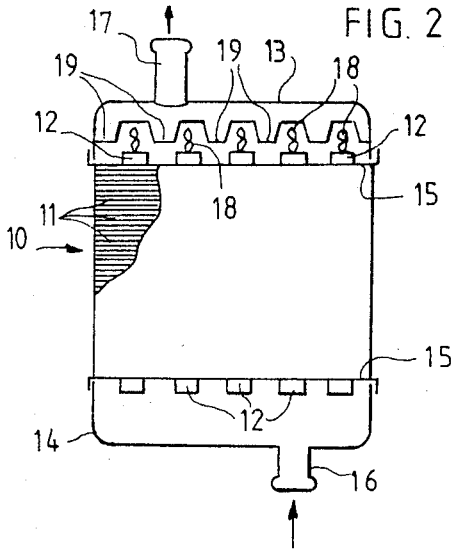
FIG. 2 is a front view of the heat exchanger.

Reference is made initially to FIGS. 1 and 2, which are diagrammatic illustrations of a heat exchanger including turbulator retaining means in accordance with the invention.

The heat exchanger comprises a heat exchanging nest of tubes arranged as two parallel rows of vertically oriented tubes for liquid circulation, associated with horizontal fins 11 for heat exchange with air. The ends 12 of the tubes in the nest open out into upper and lower water boxes 13 and 14 respectively which are mounted in conventional manner on respective nest holding perforated plates 15. The lower water box 14 includes a liquid inlet tube 16, and the upper water box 13 includes a liquid outlet tube 17. The heat exchanger shown in these figures is thus an "I" type heat exchanger.

U-shaped turbulators 18 which are bent in the middle, have two parallel leg portions of substantially equal length inserted into respective tubes in the nest of tubes. The turbulators may be made of metal or of plastic, and they may have projections, or else be helically twisted, in order to create turbulence in the tubes in which they are inserted.

In the example shown in FIGS. 1 and 2, the U-shaped mid portions of the turbulators 18 are lodged in the upper water box 13 having the outlet tube 17, and it can be readily seen that the liquid circulating in the heat exchanger will tend to entrain the turbulators towards the outlet tube and extract them from the nest of tubes.

To prevent such extraction, the invention provides stops or projections 19 formed inside the upper water box 13 and arranged to project on either side of the turbulators 18 so as to be astride the U-shaped mid portions of the turbulators, thereby limiting the distance the turbulators can move from their correct initial positions under the effect of the liquid circulating through the water box towards the outlet tube 17.

Figure 4:
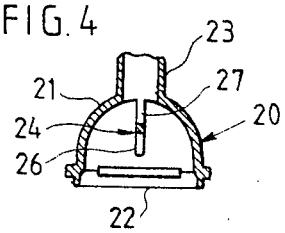
FIG. 4 is a cross section along a line IV—IV in FIG. 3.
Figure 3:
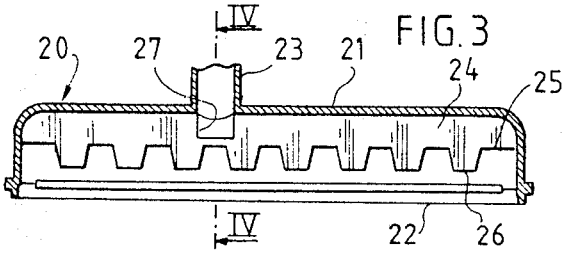
FIG. 3 is a longitudinal section on a larger scale through the water box of the exchanger shown in FIG. 2.

Reference is now made to FIGS. 3 and 4 which show a first embodiment of the invention in greater detail.

The upper water box 20 in these figures corresponds substantially to the water box 13 of FIGS. 1 and 2, and comprises a generally parallelipiped shaped box with a rounded top 21 and an open rectangular base 22 for mounting on the perforated plate 15. An outlet tube 23 rises from the top 21 and extends perpendicularly from the open rectangular base 22.

A substantially plane spine 24 projects down into the water box 20 from the center line of the top of the box 20. The lower edge 25 of the spine 24 is crenelated, i.e. it has a row of teeth 26 projecting down towards the open base 22. The teeth 26 may taper towards their crowns as shown in the drawing, or they may be of any other appropriate shape.

The teeth 26 are disposed so that they project down on either side of the U-shaped mid portions of the turbulators 18 when the water box 20 is assembled on the nest of heat exchanger tubes.

In order to avoid interfering with the liquid flowing out through the outlet tube 23, there is a hole 27 through the spine 24 where it passes in front of the outlet tube 23.

Figure 6:
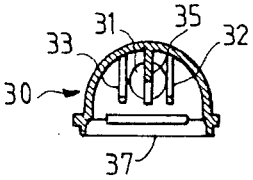
FIG. 6 is a cross section along a line VI—VI in FIG. 5.
Figure 5:
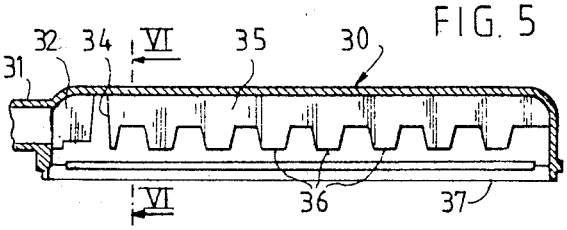
FIG. 5 is a longitudinal section through the water box of a second heat exchanger.

FIGS. 5 and 6 show a second embodiment of the invention in which the outlet tube 31 extends substantially axially from one of the ends of the water box 30.

In this case the outlet tube is flanked inside the water box 30 by two plane fins 32 and 33 which extend vertically from the top and end walls of the water box towards the central spine 35 which stops short of the fins 32 and 33. As in the previous embodiment, the spine has tapering teeth 36 projecting downwardly towards the open base 37 of the water box.

Since the spine 36 stops short of the end which opens into the outlet tube 31, it does not significantly hinder the outflow of liquid. However, the turbulator(s) nearest to the outlet end are still prevented from escaping, but by the fins 32 and 33 which flank the outlet, rather than by the central spine 35.

Figure 8:
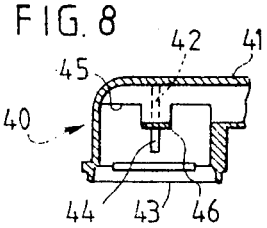
FIG. 8 is a cross section along a line VIII—VIII in FIG. 7.
Figure 7:
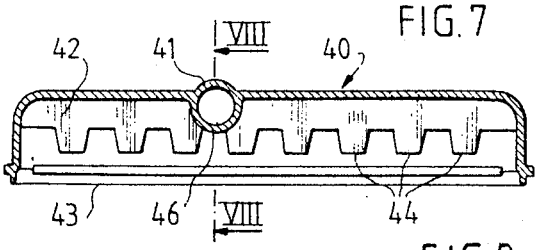
FIG. 7 is a longitudinal section through the water box of a third heat exchanger.

FIGS. 7 and 8 show a third embodiment of the invention in which the outlet tube 41 extends transversely from a point along the side of the water box 40.

As before there is a plane central spine 42 projecting down from the center line of the top of the box 40 towards its open base 43. The spine 42 has a similar row of tapering teeth 44.

It can be seen from FIG. 8 that the upper half of the outlet tube 41 extends into the water box 40, as indicated at 45, and passes through the central spine 42. Where the spine and the outlet tube intersect, the outlet tube is complete, i.e. a full ring-shaped portion 46 of the outlet tube 41 is fitted through the spine 42.

Figure 10:
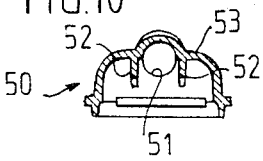
FIG. 10 is a cross section along a line X—X in FIG. 9.
Figure 9:
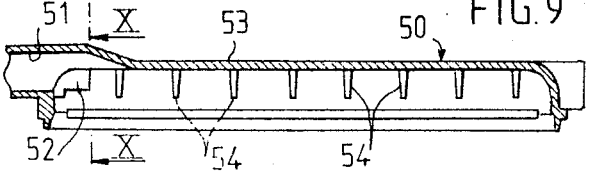
FIG. 9 is a longitudinal section through the water box of a fourth heat exchanger.

In all the embodiments described so far the water box is made as a single plastic moulding. The spine is essentially similar and serves to hold and retain the turbulators in position. The form of the spine could be changed. For example there could be two parallel spines running along either side of the center line of the top of the water box, perhaps further including optional transverse ribs between turbulators. The plane spine and ribs could be replaced by a series of fingers or prongs. Such an embodiment is shown in FIGS. 9 and 10.

In these FIGS., the water box 50 has an outlet tube 51 at one of its ends, extending along a projection of the center line of the top of the box.

In this case the outlet tube 51 is flanked inside the water box 50 by two plane fins 52 which extend vertically from the end wall and the top of the water box in a manner similar to that shown in FIGS. 5 and 6.

Fingers or prongs 54 project downwardly from the top 53 of the box 50. They may be arranged in one central row, or in two parallel rows running along either side of the center line, e.g. in line with the plane fins 52.

I claim:

1. Turbulator retaining means in a heat exchanger comprising a nest of tubes for liquid circulation and a plurality of turbulators inserted into the tubes of the nest, each turbulator having two substantially parallel leg portions inserted into two tubes of the nest and a curved U-shaped mid-portion connecting the leg portions to each other, said mid-portion being outward of the tubes, said turbulator retaining means comprising stops extending on either side of the said U-shaped mid-portion of each turbulator to restrict movement of said turbulator out from the tubes under the effect of the liquid flowing through the tubes.

2. Turbulator retaining means according to claim 1, wherein said stops extend in between the mid-portions of adjacent turbulators.

3. Turbulator retaining means according to claim 1, wherein the heat exchanger includes a water box overlying the nest of tubes and enclosing the mid-portions of the turbulators, said water box having an interior surface, and wherein said stops are affixed to and extend from the interior surface of said water box.

4. Turbulator retaining means according to claim 3, wherein said stops are constituted by at least one crenelated spine projecting from the interior surface of said water box at a position generally opposite to the nest of tubes.

5. Turbulator retaining means according to claim 4, wherein there is a single crenelated spine projecting from a center line of the water box.

6. Turbulator retaining means according to claim 4, wherein said water box includes a liquid outlet and there is a hole through said spine adjacent said liquid outlet.

7. Turbulator retaining means according to claim 6, wherein said liquid outlet is in the form of a tube which extends into the box at right angles to the spine.

8. Turbulator retaining means according to claim 3, wherein the water box includes a liquid outlet which is flanked by two planar turbulator retaining fins projecting into the water box.

9. Turbulator retaining means according to claim 4, wherein said stops comprise a plurality of spines and/or ribs projecting from the interior surface of the box opposite to the nest of tubes.

10. A water box for a heat exchanger of the type including U-shaped turbulators inserted into tubes in a nest of tubes with a mid-portion of each of the turbulators projecting outward of the nest, wherein the water box is adapted to enclose the projecting mid-portions and has an interior surface, the water box including turbulator retaining means comprising multiple stops affixed to the interior surface of the box at equally spaced points therealong, said stops projecting from the interior surface for alignment between the turbulator mid-portions.

11. A heat exchanger comprising a nest of tubes for liquid circulation and a plurality of turbulators inserted into the tubes of the nest, each turbulator comprising two substantially parallel leg portions having first ends interconnected by a curved mid-portion, the two leg portions of each turbulator being inserted into a pair of tubes of the nest with the curved mid-portion projecting outwardly of said pair of tubes, said nest of tubes comprising multiple pairs of tubes, each receiving one of said turbulators with the mid-portion of each of said turbulator projecting outward of the corresponding pair of tubes and, turbulator retaining means comprising stops positioned laterally of each pair of tubes and between the projecting mid-portions of adjacent turbulators to restrict lateral shifting and movement of said turbulators out from the tubes under the effect of the liquid flowing through the tubes.

12. The heat exchanger of claim 11 including a water box mounted on the nest of tubes and overlying the turbulator mid-portions, said water box having an interior surface spaced outward of said mid-portions, said stops comprising a series of equally spaced projections affixed to said interior surface, each of said projections extending from the interior surface of the water box to a position between each mid-portion and the adjacent mid-portions to define a restriction to movement of the turbulators.

13. The heat exchanger of claim 12, wherein said projections are defined along an elongated spine affixed to the interior surface of the water box in generally opposed relation to the pairs of tubes.

* * * * *